US011488738B2

(12) United States Patent
Lemer

(10) Patent No.: US 11,488,738 B2
(45) Date of Patent: Nov. 1, 2022

(54) RADIO-PROTECTIVE SHIELD

(71) Applicant: LEMER PAX, La Chapelle sur Erdre (FR)

(72) Inventor: Pierre-Marie Lemer, Nantes (FR)

(73) Assignee: LEMER PAX, La Chapelle sur Erdre (FR)

( * ) Notice: Subject to any disclaimer, the term of this patent is extended or adjusted under 35 U.S.C. 154(b) by 0 days.

(21) Appl. No.: 17/428,134

(22) PCT Filed: Feb. 4, 2020

(86) PCT No.: PCT/HR2020/050184

§ 371 (c)(1),
(2) Date: Aug. 3, 2021

(87) PCT Pub. No.: WO2020/161432

PCT Pub. Date: Aug. 13, 2020

(65) Prior Publication Data

US 2022/0130565 A1 Apr. 28, 2022

(30) Foreign Application Priority Data

Feb. 5, 2019 (FR) ..... 1901123

(51) Int. Cl.
*G21F 7/03* (2006.01)

(52) U.S. Cl.
CPC ..... *G21F 7/03* (2013.01)

(58) Field of Classification Search
CPC ..... G21F 7/03
USPC ..... 250/505.1, 506.1, 507.1, 515.1, 516.1, 250/517.1, 518.1, 519.1
See application file for complete search history.

(56) References Cited

U.S. PATENT DOCUMENTS

| | | | | |
|---|---|---|---|---|
| 3,505,525 | A | 4/1970 | Sandore | |
| 7,257,927 | B2 | 8/2007 | Sayer | |
| 11,045,155 | B2 * | 6/2021 | Lemer | G21F 3/00 |

FOREIGN PATENT DOCUMENTS

| | | |
|---|---|---|
| EP | 0 430 687 | 6/1991 |
| FR | 1.333.746 | 8/1963 |

OTHER PUBLICATIONS

International Search Report for PCT/FR2020/050184 dated Jun. 3, 2020, 6 pages.
Written Opinion of the ISA for PCT/FR2020/050184 dated Jun. 3, 2020, 5 pages.

* cited by examiner

*Primary Examiner* — Nicole M Ippolito
(74) *Attorney, Agent, or Firm* — Nixon & Vanderhye

(57) ABSTRACT

Disclosed is a radio-protective shield including: a wall made from transparent material, with a peripheral edge of a first face of the wall made from transparent material coming to bear against a bearing face of a counter-frame via a seal; a fastening frame provided with bearing a bearing against a peripheral edge of a second face of the wall made from transparent material, which bearing includes a longitudinal bearing structure including a contact surface in contact with the peripheral edge. The radio-protective shield further includes a securing element securing the counter-frame and the fastening frame together. The bearing includes an elastic return capable of applying pressure against the longitudinal bearing structure towards the wall made from transparent material.

20 Claims, 2 Drawing Sheets

RADIO-PROTECTIVE SHIELD

CROSS-REFERENCE TO RELATED APPLICATIONS

This application is the U.S. national phase of International Application No. PCT/FR2020/050184 filed Feb. 4, 2020 which designated the U.S. and claims priority to French Application No. 1901123 filed Feb. 5, 2019, the entire contents of each of which are hereby incorporated by reference.

BACKGROUND OF THE INVENTION

Field of the Invention

The present invention relates to the technical field of protection against ionising radiations.

More particularly, it relates to a radio-protective shield intended to be fastened on the periphery of an opening formed in a wall separating a space subjected to ionising radiations (called hot space), and a space that is not subjected to ionising radiations (called cold space).

It also relates to a shielded cell enclosing a space subjected to ionising radiations, comprising a metallic internal coating and at least one anti-radiation window enabling visual access from the outside to the inside of said shielded cell, which anti-radiation window comprises a sheath embedded in a concrete wall, which sheath receives a shielded porthole which is associated to a radio-protective shield fastened on the periphery of an opening formed in said metallic internal coating.

Description of the Related Art

In some waste reprocessing plants, or some laboratories, there are shielded cells within which operations on radioactive materials are carried out.

These shielded cells are surrounded by walls adapted to ensure an effective protection against ionising radiations, and they generally comprise at least one window enabling visual monitoring from outside of the operations carried out inside (cf. for example U.S. Pat. No. 7,257,927, EP 0 430 687, U.S. Pat. No. 3,505,525, FR 1 333 746).

Such windows (called anti-radiation windows) may comprise a sheath, embedded in a concrete wall, which sheath receives a shielded porthole composed by a mount made of cast iron integrating a plurality of anti-radiation glass slabs.

In addition, on the internal side (also called "hot space"), the shielded enclosure may include a radio-protective shield, positioned opposite the shielded porthole. This radio-protective shield (also called "alpha glass"), is fastened on the periphery of an opening formed in a metallic internal coating which covers the walls of the shielded enclosure.

The considered radio-protective shield comprises a wall made of a transparent material whose periphery is sandwiched in a carrier set composed by a fastening frame and by a counter-frame, enabling fastening by welding with the internal coating of the shielded enclosure.

The wall made of a radiation-shielding transparent material is delimited by a first face, intended to be directed on the external "cold space" side, and by a second face intended to be directed on the internal "hot space" side. A peripheral edge of this first wall face bears against a bearing face of the counter-frame through a seal made of an organic material (in general EPDM or neoprene). And the fastening frame is provided with bearing means, with a seal, against a peripheral edge of the second face of the wall made of a transparent material.

However, the seals interposed between the wall made of a transparent material of the radio-protective shield and the counter-frame and fastening frame deteriorate quite rapidly over time, because of the high amounts of radiations to which they are subjected, and it is necessary to replace them on a regular basis, which, in this context, is not easy to carry out and generate considerable costs.

SUMMARY OF THE INVENTION

In order to overcome the aforementioned drawback if the state of the art, the present invention provides a radio-protective shield intended to be fastened on the periphery of an opening formed in a wall separating a space subjected to ionising radiations, called hot space, and a space not subjected to ionising radiations, called cold space, which radio-protective shield comprises a wall made of a transparent material, said wall made of a transparent material comprising a first face intended to be directed on said cold space side, and a second face intended to be directed on said hot space side, a peripheral edge of one of said first face or second face of said wall made of a transparent material bearing against a bearing face of a counter-frame through a seal, said radio-protective shield comprising a fastening frame provided with means for bearing against a peripheral edge of the other one of said first face or second face of said wall made of a transparent material, which bearing means comprise a longitudinal bearing structure comprising a contact surface with the peripheral edge of the first face or of the second face opposite said wall made of a transparent material, which radio-protective shield also comprises securing means for securing together said counter-frame and said fastening frame, this radio-protective shield being characterised by the fact that said bearing means comprise elastic return means adapted to apply a pressure against said longitudinal bearing structure in the direction of said wall made of a transparent material.

Such a particularity enables the use of seals that resist ionising radiations very well, in particular gaskets made of an inorganic material (advantageously gaskets made of a soft metal, that is to say malleable or ductile, selected from lead, copper, tin or cadmium, in the pure state or in an alloyed form), or gaskets made of graphite.

Other non-limiting and advantageous features of the radio-protective shield in accordance with the invention, considered separately or according to any technically-feasible combinations, are as follows:

- the elastic return means consist of a plurality of spring members evenly, or at least almost evenly, distributed over the periphery of said fastening frame;
- said spring members consist of Belleville washers;
- the longitudinal bearing structure comprises a pressure metallic profile associated to an affixed bearing profile forming said surface of contact with the peripheral edge of the face opposite the wall made of a transparent material and forming a seal;
- said affixed bearing profile is made of a material selected from (i) soft metals, preferably lead, copper, tin and cadmium, in the pure state or in an alloyed form, and (ii) graphite;

at least some of the elastic return means are associated to pressure setting screws adapted to enable setting of the pressure applied by said elastic return means on said longitudinal bearing structure;

each of at least some of said Belleville washers is associated to a pressure setting screw.

The present invention also relates to a shielded cell enclosing a space subjected to ionising radiations, comprising a metallic internal coating and at least one anti-radiation window enabling visual access from the outside to the inside of said shielded cell, which anti-radiation window comprises a sheath embedded in a concrete wall, which sheath receives a shielded porthole which is associated to a radio-protective shield as defined hereinabove, fastened on the periphery of an opening formed in said metallic internal coating.

Of course, the different features, variants and embodiments of the invention may be associated with one another according to various combinations provided that they are not incompatible or do not exclude each other.

BRIEF DESCRIPTION OF THE DRAWINGS

In addition, various other features of the invention will appear from the appended description made with reference to the drawings which illustrate non-limiting embodiments of the invention and where.

DESCRIPTION OF THE PREFERRED EMBODIMENTS

Figure 1:
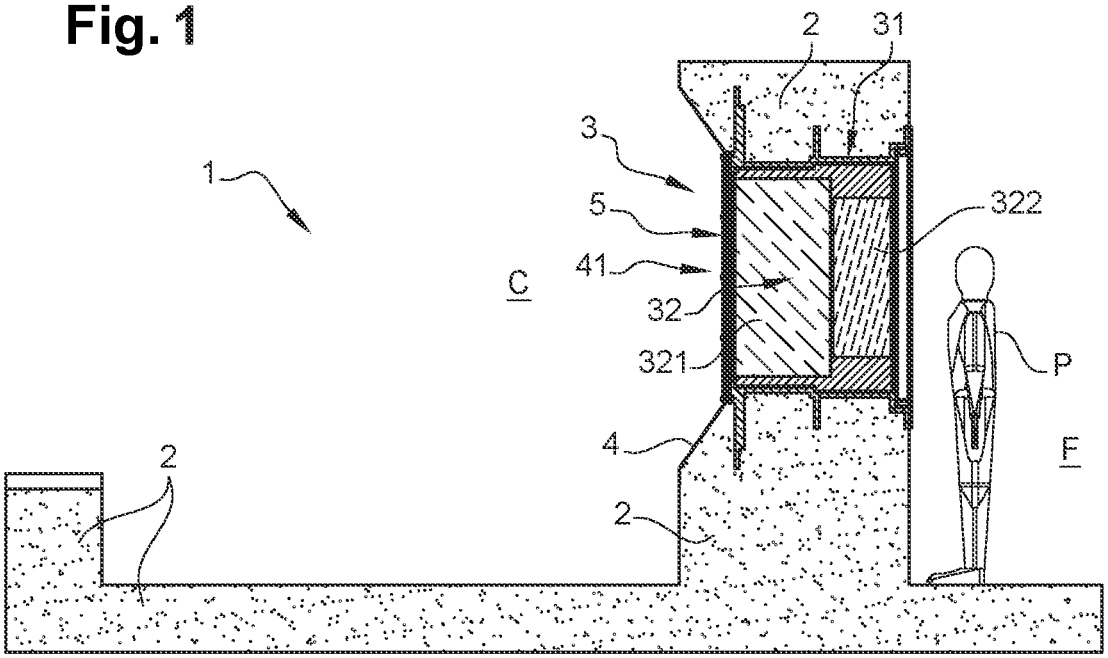
FIG. 1 is a schematic vertical sectional view which illustrates a shielded cell integrating an anti-radiation window equipped, on the hot space side, with a radio-protective shield in accordance with the invention.

The shielded cell 1 illustrated in FIG. 1 is delimited by the concrete walls 2 (represented partially) in one of which an anti-radiation window 3 is formed.

The concrete walls 2 have a large thickness which could range up to 1.5 metres.

The anti-radiation window 3 is adapted to enable a person P located outside the shielded cell 1, on the cold space F side, to monitor operations carried out on radioactive products within the inner hot space C.

This anti-radiation window 3 comprises a sheath 31 in the form of a metallic frame, for example made of steel or of cast iron, embedded in the concrete wall 2 of the shielded cell 1, this sheath 31 receiving a shielded porthole 32 consisting of an optical block formed herein by two lead-glass slabs 321 and 322.

Figure 2:
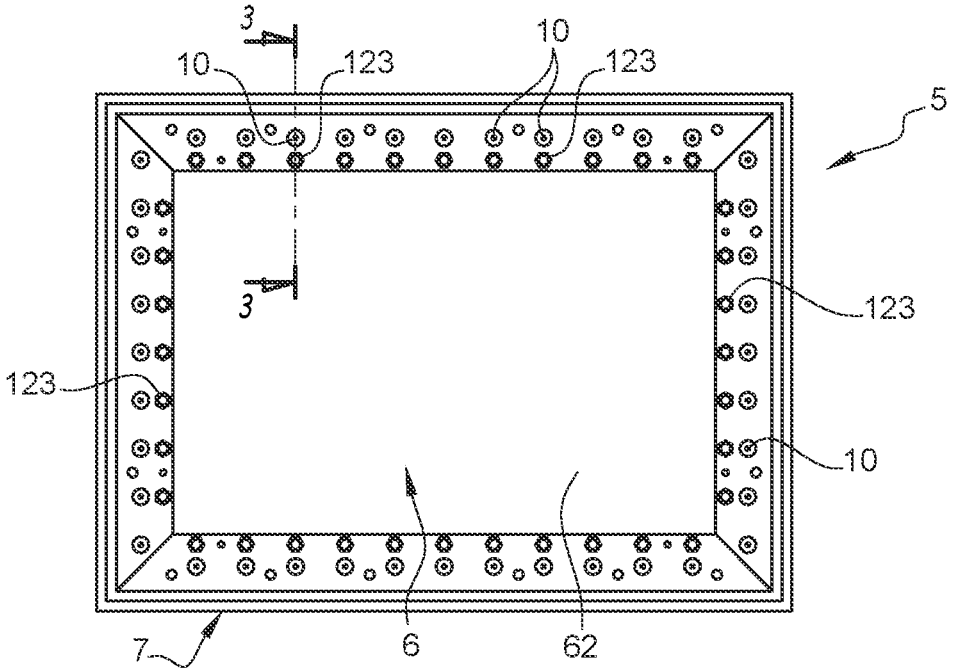
FIG. 2 shows the radio-protective shield of the anti-radiation window illustrated in FIG. 1, in front view on the hot space side of the shielded cell.
Figure 3:
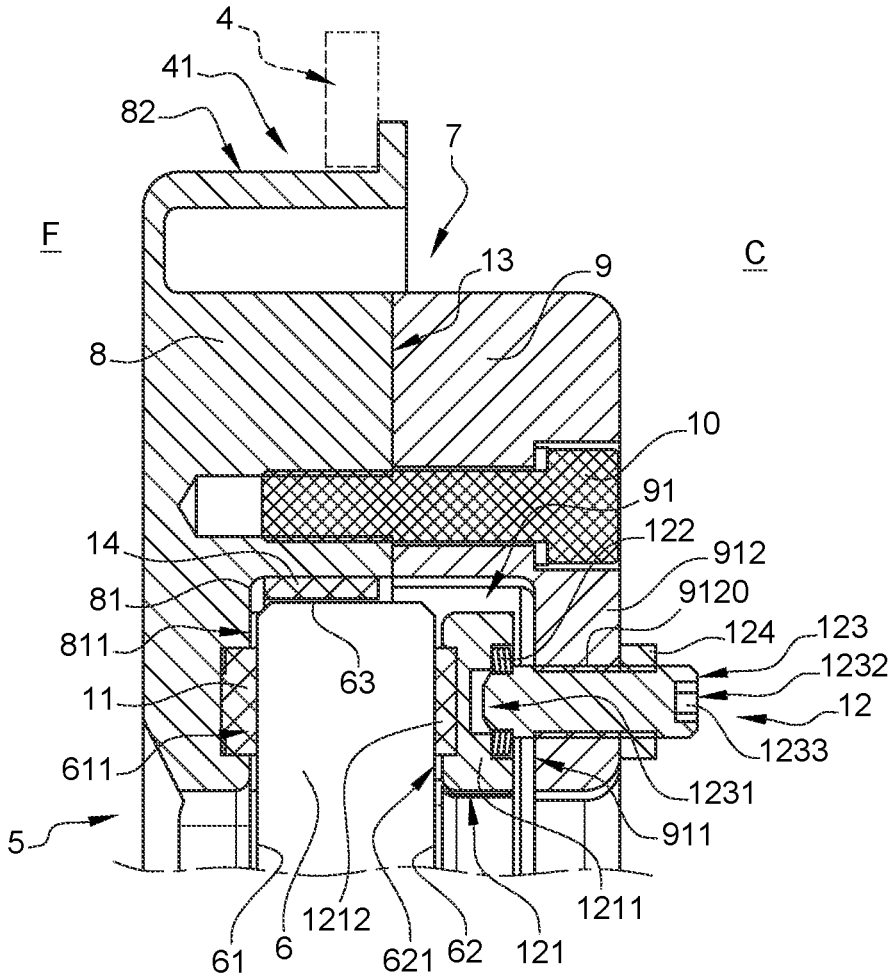
FIG. 3 is a sectional view according to a sectional plane 3-3 of FIG. 2.

On the hot space C side, the inside of the shielded cell 1 includes a metallic coating 4 in which an opening 41 is formed opposite the anti-radiation window 3, and over the periphery of which opening 41 the periphery of a radio-protective shield 5, detailed in FIGS. 2 and 3, is fastened by welding.

Advantageously, the metallic coating 4, also called "lining", is made of stainless steel.

The radio-protective shield 5 comprises a wall 6 made of a transparent material, delimited by a first face 61 intended to be directed on the cold space F side of the shielded cell 1 (that is to say directed towards the lead-glass slabs 321 and 322), and a second face 62 intended to be directed on the hot space C side.

These first and second faces 61, 62 of the wall 6 made of a transparent material are connected by an edge 63.

The wall 6 made of a transparent material may be made of glass.

This radio-protective shield 5 also comprises a peripheral structure 7, formed by a counter-frame 8 and by a fastening frame 9, which peripheral structure 7 is adapted to hold the wall 6 made of a transparent material and to enable fastening thereof to the metallic coating 4 of the shielded enclosure 1.

For this purpose, the periphery of the wall 6 made of a transparent material is sandwiched between the counter-frame 8 and the fastening frame 9, and securing means, herein in the form of screws 10, ensuring securing between these counter-frame 8 and fastening frame 9.

More specifically, the periphery of the wall 6 made of a transparent material is positioned in a rebate 81 of the counter-frame 8, with a peripheral edge 611 of the first face 61 of this wall 6 made of a transparent material which is positioned in said rebate 81, against a bearing face 811 of the counter-frame 8, through a seal 11.

Besides, the periphery of the wall 6 made of a transparent material is positioned in a rebate 91 of the fastening frame 9, with a peripheral edge 621 of the second face 62 of this wall 6 made of a transparent material being positioned in said rebate 91, opposite the face 911 of a web 912 of this rebate 91; and the fastening frame 9 is provided with means 12 for bearing against said peripheral edge 621 of the second face 62 of said wall 6 made of a transparent material.

These bearing means 12 comprise:

a longitudinal bearing structure 121 formed by a pressure metallic profile 1211 associated to an affixed bearing profile 1212 forming a contact surface and a seal with the peripheral edge 621 of the second face 62 of the wall 6 made of a transparent material, and elastic return means 122 adapted to apply a pressure against the longitudinal bearing structure 121 (in the direction of the wall 6 made of a transparent material), these elastic return means 122 being associated to pressure setting screws 123.

The affixed bearing profile 1212 is associated to the pressure metallic profile 1211 by gluing or by simple interlocking of complementary shapes.

The elastic return means consist of a plurality of spring members in the form of Belleville washers 122 evenly, or almost evenly, distributed over the periphery of the fastening frame 9, each being interposed between the pressure metallic profile 1211 and the active end 1231 of the pressure setting screws 123.

The pressure setting screws 123 cross the web 912 of the rebate 91 of the fastening frame 9 through a threaded orifice 9120. And the end 1232 of the pressure setting screws 123, that is opposite to that 1231 cooperating with the associated Belleville washer 122, is accessible from outside the fastening frame 9. This screw opposite end 1232 cooperates with a lock nut 124 and includes an imprint 1233 for rotational maneuvering thereof by a suitable tool (such as a key, a screwdriver . . . ).

It should be understood that the rotational manoeuvre of the pressure setting screws 123 enables setting of the pressure applied by the elastic return means 122 on the longitudinal bearing structure 121, and therefore of the pressure applied by the bearing profile 1212 on the wall 6 made of a transparent material, in the direction of the counter-frame 8 and of its seal 11.

For example, the pressure metallic profile 1211 is made of steel, stainless steel (inox), bronze or brass.

In turn, the seals 11 and 1212 may be made of an inorganic material. Thus, they may be made of a soft metal (that is to say malleable/ductile), preferably selected from lead, copper, tin or cadmium (in the pure state or in an alloyed form).

They may also be made of graphite.

Preferably, the two gasket structures 11 and 1212 are made of the same material.

The fastening frame 9 and the counter-frame 8 are in contact with one another at a contact plane 13 crossed by the securing screws 10.

These securing screws 10 are evenly, or at least almost evenly, distributed over the periphery of the fastening frame 9 and the counter-frame 8, for example according to the same pitch as the pressure setting screws 123.

In FIG. 3, notice the presence of a wedging structure 14 interposed between the edge 63 of the wall 6 made of a transparent material and the side of the rebate 81 of the counter-frame 8.

Still in FIG. 3, notice the presence of a lateral extension 82 of the counter-frame 8, made integrally in one-piece, which is adapted to achieve fastening by welding with the peripheral edge of the opening 41 formed in the metallic coating (or lining) 4 of the shielded cell 1.

It should be noted that in some particular configurations, the radio-protective shield 5 may be fastened in the other direction on the peripheral edge of the opening 41, that is to say with the counter-frame 8 directed on the hot space C side and the fastening frame 9 directed on the cold space F side (in particular to enable the dismount of the fastening frame 9 from the cold space F side).

The bearing means 12 according to the invention allow applying a permanent pressure on the seal 11 sandwiched between the wall 6 made of a transparent material and the bearing face 811 of the rebate 81 of the counter-frame 8, and also on the seal 1212 sandwiched between the wall 6 made of a transparent material and the fastening frame 9.

Such a particularity enables the use of seals 11 and 1212 that resist ionising radiations very well, but which, by their nature, could tend to slightly collapse or creep over time.

The bearing means 12 then form a system for elastically compensating creeping by holding the pressure on the seals.

The invention claimed is:

1. A radio-protective shield configured to be fastened on the periphery of an opening formed in a wall separating a hot space subjected to ionizing radiations and a cold space not subjected to ionizing radiations, the radio-protective shield comprising:

a wall made of a transparent material, said wall made of a transparent material comprising a first face configured to be directed on said cold space side, and a second face configured to be directed on said hot space side, a peripheral edge of one of said first face or second face of said wall made of a transparent material bearing against a bearing face of a counter-frame through a seal;

a fastening frame provided with a bearing system configured to bear against a peripheral edge of the other one of said first face or second face of said wall made of a transparent material, the bearing system comprising a longitudinal bearing structure comprising a contact surface with the peripheral edge of the first face or of the second face opposite said wall made of a transparent material, said bearing system comprising an elastic return system configured to apply a pressure against said longitudinal bearing structure in the direction of said wall made of a transparent material; and a securing system configured to secure together said counter-frame and said fastening frame.

2. The radio-protective shield according to claim 1, wherein said seal is made of a soft metal, in the pure state or in an alloyed form.

3. The radio-protective shield according to claim 1, wherein said seal is made of graphite.

4. The radio-protective shield according to claim 1, wherein said elastic return system consists of a plurality of spring members evenly, or at least almost evenly, distributed over the periphery of said fastening frame.

5. The radio-protective shield according to claim 4, wherein said spring members consist of Belleville washers.

6. The radio-protective shield according to claim 1, wherein said longitudinal bearing structure comprises a pressure metallic profile associated to an affixed bearing profile forming said surface of contact with the peripheral edge of the face opposite the wall made of a transparent material and forming a seal.

7. The radio-protective shield according to claim 6, wherein said affixed bearing profile is made of a material selected from soft metals and graphite.

8. The radio-protective shield according to claim 1, wherein at least some of said elastic return system is associated to pressure setting screws configured to enable setting of the pressure applied by said elastic return system on said longitudinal bearing structure.

9. The radio-protective shield according to claim 8, wherein said spring members consist of Belleville washers, and wherein each of at least some of said Belleville washers is associated to a pressure setting screw.

10. A shielded cell enclosing a space subjected to ionizing radiations, the shielded cell comprising:

a metallic internal coating; and at least one anti-radiation window enabling visual access from the outside to the inside of said shielded cell, the at least one anti-radiation window comprising a sheath embedded in a concrete wall, the sheath receiving a shielded porthole which is associated to the radio-protective shield according to claim 1, fastened on the periphery of an opening formed in said metallic internal coating.

11. The radio-protective shield according to claim 2, wherein said soft metal is selected from the group consisting of lead, copper, tin or cadmium, in a pure state or in an alloyed form.

12. The radio-protective shield according to claim 2, wherein said elastic return system consists of a plurality of spring members evenly, or at least almost evenly, distributed over the periphery of said fastening frame.

13. The radio-protective shield according to claim 3, wherein said elastic return system consists of a plurality of spring members evenly, or at least almost evenly, distributed over the periphery of said fastening frame.

14. The radio-protective shield according to claim 2, wherein said longitudinal bearing structure comprises a pressure metallic profile associated to an affixed bearing profile forming said surface of contact with the peripheral edge of the face opposite the wall made of a transparent material and forming a seal.

15. The radio-protective shield according to claim 3, wherein said longitudinal bearing structure comprises a pressure metallic profile associated to an affixed bearing profile forming said surface of contact with the peripheral edge of the face opposite the wall made of a transparent material and forming a seal.

16. The radio-protective shield according to claim 2, wherein at least some of said elastic return system is associated to pressure setting screws configured to enable setting of the pressure applied by said elastic return system on said longitudinal bearing structure.

17. The radio-protective shield according to claim 3, wherein at least some of said elastic return system is associated to pressure setting screws configured to enable setting of the pressure applied by said elastic return system on said longitudinal bearing structure.

18. The radio-protective shield according to claim 4, wherein at least some of said elastic return system is associated to pressure setting screws configured to enable setting of the pressure applied by said elastic return system on said longitudinal bearing structure.

19. The radio-protective shield according to claim 5, wherein at least some of said elastic return system is associated to pressure setting screws configured to enable setting of the pressure applied by said elastic return system on said longitudinal bearing structure.

20. The radio-protective shield according to claim 6, wherein at least some of said elastic return system is associated to pressure setting screws configured to enable setting of the pressure applied by said elastic return system on said longitudinal bearing structure.

* * * * *